US011220865B2

(12) United States Patent
Hall et al.

(10) Patent No.: US 11,220,865 B2
(45) Date of Patent: Jan. 11, 2022

(54) DOWNHOLE DRILLING APPARATUS WITH ROTATABLE CUTTING ELEMENT

(71) Applicant: Novatek IP, LLC, Provo, UT (US)

(72) Inventors: David R. Hall, Provo, UT (US); Jonathan D. Marshall, Provo, UT (US); Malcolm Roy Taylor, Gloucester (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 257 days.

(21) Appl. No.: 16/284,275

(22) Filed: Feb. 25, 2019

(65) Prior Publication Data

US 2020/0270950 A1 Aug. 27, 2020

(51) Int. Cl.

| | |
|---|---|
| ***E21B 10/43*** | (2006.01) |
| ***E21B 17/20*** | (2006.01) |
| ***E21B 3/025*** | (2006.01) |
| ***E21B 7/06*** | (2006.01) |
| ***E21B 7/24*** | (2006.01) |
| *E21B 15/04* | (2006.01) |

(52) U.S. Cl.

CPC ..... *E21B 7/064* (2013.01); *E21B 3/025* (2013.01); *E21B 7/24* (2013.01); *E21B 10/43* (2013.01); *E21B 17/20* (2013.01); *E21B 15/04* (2013.01)

(58) Field of Classification Search

CPC ..... E21B 10/43; E21B 15/04; E21B 17/20; E21B 3/025; E21B 7/064; E21B 7/24; E21B 10/62; E21B 4/006; F15B 15/1428; F15B 15/1452; F15B 15/1457; F15B 15/22; F15B 2215/30

See application file for complete search history.

(56) References Cited

U.S. PATENT DOCUMENTS

| | | | | |
|---|---|---|---|---|
| 4,222,446 A | | 9/1980 | Vasek | |
| 4,511,006 A | | 4/1985 | Grainger | |
| 4,553,615 A | | 11/1985 | Grainger | |
| 4,690,228 A | | 9/1987 | Voelz et al. | |
| 4,690,229 A | * | 9/1987 | Raney | E21B 10/43 175/325.4 |
| 4,751,972 A | | 6/1988 | Jones et al. | |
| 6,142,250 A | * | 11/2000 | Griffin | E21B 7/068 175/381 |
| 7,604,073 B2 | | 10/2009 | Cooley et al. | |
| 7,703,559 B2 | | 4/2010 | Shen et al. | |
| 7,845,436 B2 | | 12/2010 | Cooley et al. | |

(Continued)

*Primary Examiner* — Daniel P Stephenson

(57) ABSTRACT

A downhole drilling apparatus may comprise a rotatable body with fixed cutting elements protruding from an exterior thereof. To form a subterranean borehole, the fixed cutting elements, spaced at a constant radius from a rotational axis of the body, may degrade an earthen formation as the body rotates. The body may also have a rotatable cutting element protruding from its exterior. To remove material from an interior wall of the borehole, the rotatable cutting element may be positioned in a first rotational orientation wherein it extends radially beyond the constant radius of the fixed cutting elements. An amount of material being removed may be altered by rotating the rotatable cutting element into a second rotational orientation wherein it remains radially within the constant radius.

20 Claims, 8 Drawing Sheets

(56) References Cited

U.S. PATENT DOCUMENTS

| | | | | |
|---|---|---|---|---|
| 7,849,936 | B2 * | 12/2010 | Hutton | E21B 7/064 175/61 |
| 7,987,931 | B2 | 8/2011 | Cooley et al. | |
| 8,087,479 | B2 * | 1/2012 | Kulkarni | E21B 10/62 175/73 |
| 8,141,657 | B2 * | 3/2012 | Hutton | E21B 7/06 175/61 |
| 8,202,335 | B2 | 6/2012 | Cooley et al. | |
| 8,353,974 | B2 | 1/2013 | Cooley et al. | |
| 8,561,728 | B2 | 10/2013 | Cooley et al. | |
| 8,763,726 | B2 * | 7/2014 | Johnson | E21B 7/06 175/263 |
| 8,931,582 | B2 | 1/2015 | Cooley et al. | |
| 8,950,516 | B2 | 2/2015 | Newman | |
| 9,382,762 | B2 | 7/2016 | Cooley et al. | |
| 9,920,579 | B2 | 3/2018 | Newman | |
| 10,100,584 | B1 | 10/2018 | Schroder et al. | |
| 10,577,917 | B2 * | 3/2020 | Marshall | E21B 17/02 |
| 10,633,923 | B2 * | 4/2020 | Downton | E21B 7/064 |
| 10,669,786 | B2 * | 6/2020 | Marshall | E21B 17/028 |
| 10,837,234 | B2 * | 11/2020 | Marshall | E21B 10/32 |
| 2013/0292185 | A1 * | 11/2013 | Knull | E21B 10/62 175/408 |
| 2017/0204677 | A1 * | 7/2017 | Yu | E21B 10/42 |
| 2020/0270950 | A1 * | 8/2020 | Hall | E21B 10/62 |

* cited by examiner

DOWNHOLE DRILLING APPARATUS WITH ROTATABLE CUTTING ELEMENT

BACKGROUND

When exploring for or extracting subterranean resources, such as oil, gas, or geothermal energy, and in similar endeavors, it is common to form boreholes in the earth. Such boreholes may be formed by engaging the earth with a rotating drill bit capable of degrading tough earthen materials. As rotation continues the borehole may elongate and the drill bit may be fed into it on the end of a drill string.

At times it may be desirable to alter a direction of travel of the drill bit as it is forming a borehole. This may be to steer toward valuable resources or away from obstacles. A variety of techniques have been developed to accomplish such steering. One such technique comprises pushing off an interior wall of a borehole with a radially extendable pad. This pushing may urge the drill bit laterally into the interior wall opposite from the pad. Extension of the pad may be timed in coordination with rotation of the drill bit to effect consistent steering.

Another steering technique comprises giving a borehole a cross-sectional shape that urges the drill bit in a lateral direction. For example, a cross-sectional shape comprising two circular arcs, one larger than the drill bit and one smaller, may urge the drill bit away from the smaller circular arc and into the open space provided by the larger circular arc. Such a cross-sectional shape may be formed by a radially extendable cutting element that may degrade an interior wall of a borehole when extended, to form a larger circular arc. As with an extendable pad, extension of an extendable cutting element may be timed in coordination with drill bit rotation to form a consistent borehole shape.

While these techniques have proven sufficient for their intended purposes, systems achieving greater steering while expending less energy and prolonging a useful life of a tool would be desirable.

BRIEF DESCRIPTION

A drill bit may be rotated to form a borehole through the earth. Such a drill bit may comprise fixed cutting elements, capable of degrading subterranean materials, protruding from an exterior of a body. These fixed cutting elements may be spaced at a constant radius from a rotational axis of the body to form an initially cylindrical borehole.

The body may also comprise at least one rotatable cutting element protruding from its exterior. To remove earthen material from an internal wall of the borehole, the rotatable cutting element may be positioned in a first rotational orientation wherein it may extend radially beyond the constant radius of the fixed cutting elements. To stop removing material from the borehole wall, the rotatable cutting element may be positioned in a second rotational orientation wherein it may remain radially within the constant radius.

Rotation of the rotatable cutting element may be synchronized with rotation of the drill bit to provide consistent removal in certain angular sections of the borehole. By altering material removal in these angular sections various borehole cross-sectional shapes may be formed. Specifically, a borehole may be provided with a smaller internal radius at some angular positions that may urge the drill bit laterally into other angular positions comprising a larger internal radius to steer the drill bit.

DRAWINGS

FIGS. 3-1 and 3-2 are orthogonal views of embodiments of a drill bit comprising a rotatable cutting element, shown in magnified view, in different rotational orientations.

FIGS. 4-1 and 4-2 are orthogonal views of embodiments of rotatable cutting elements in different rotational orientations.

FIGS. 5-1 and 5-2 are perspective views of embodiments of a drill bit comprising a rotatable cutting element rotatable by means of a torque-generating apparatus comprising a rack and pinion gear configuration.

FIGS. 6-1 and 6-2 are perspective views of embodiments of a rotatable cutting element rotatable by means of a torque-generating apparatus comprising a worm gear configuration.

FIGS. 7-1 and 7-2 are perspective views of embodiments of a rotatable cutting element rotatable by means of a torque-generating apparatus, capable of contacting an external formation, and limited by a braking apparatus.

DETAILED DESCRIPTION

Figure 1:
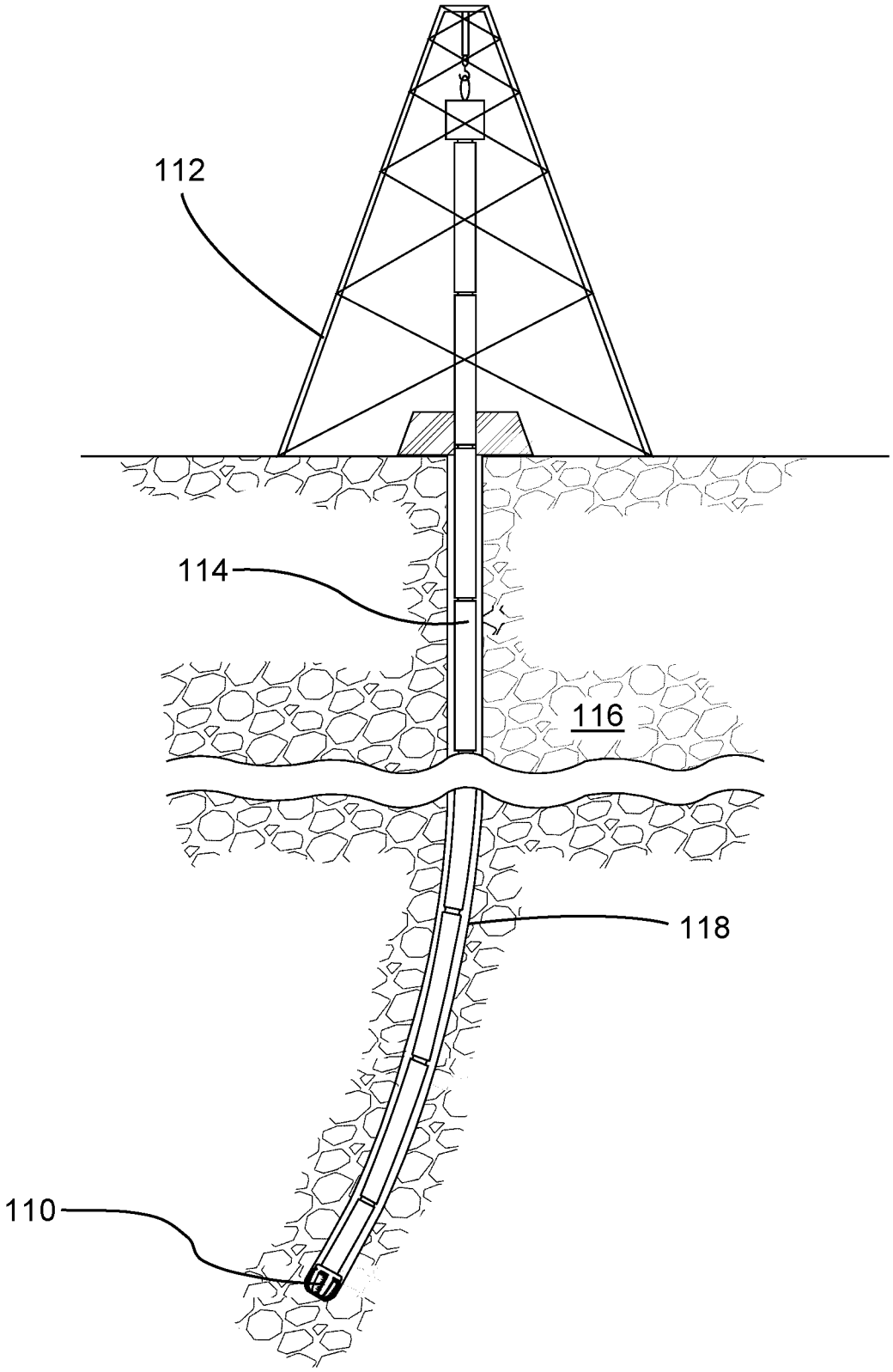
FIG. 1 is an orthogonal view of an embodiment of a subterranean drilling operation.

Referring now to the figures, FIG. 1 shows an embodiment of a subterranean drilling operation of the type commonly used to form boreholes in the earth. As part of this drilling operation, a drill bit 110 may be suspended from a derrick 112 by a drill string 114. While a land-based derrick 112 is depicted, comparable water-based structures are also common. Such a drill string 114 may be formed from a plurality of drill pipe sections fastened together end-to-end, as shown, or, alternately, a flexible tubing. The drill string 114 may be fed into a borehole 118 formed in a subterranean formation 116 by rotation of the drill bit 110.

Figure 2:
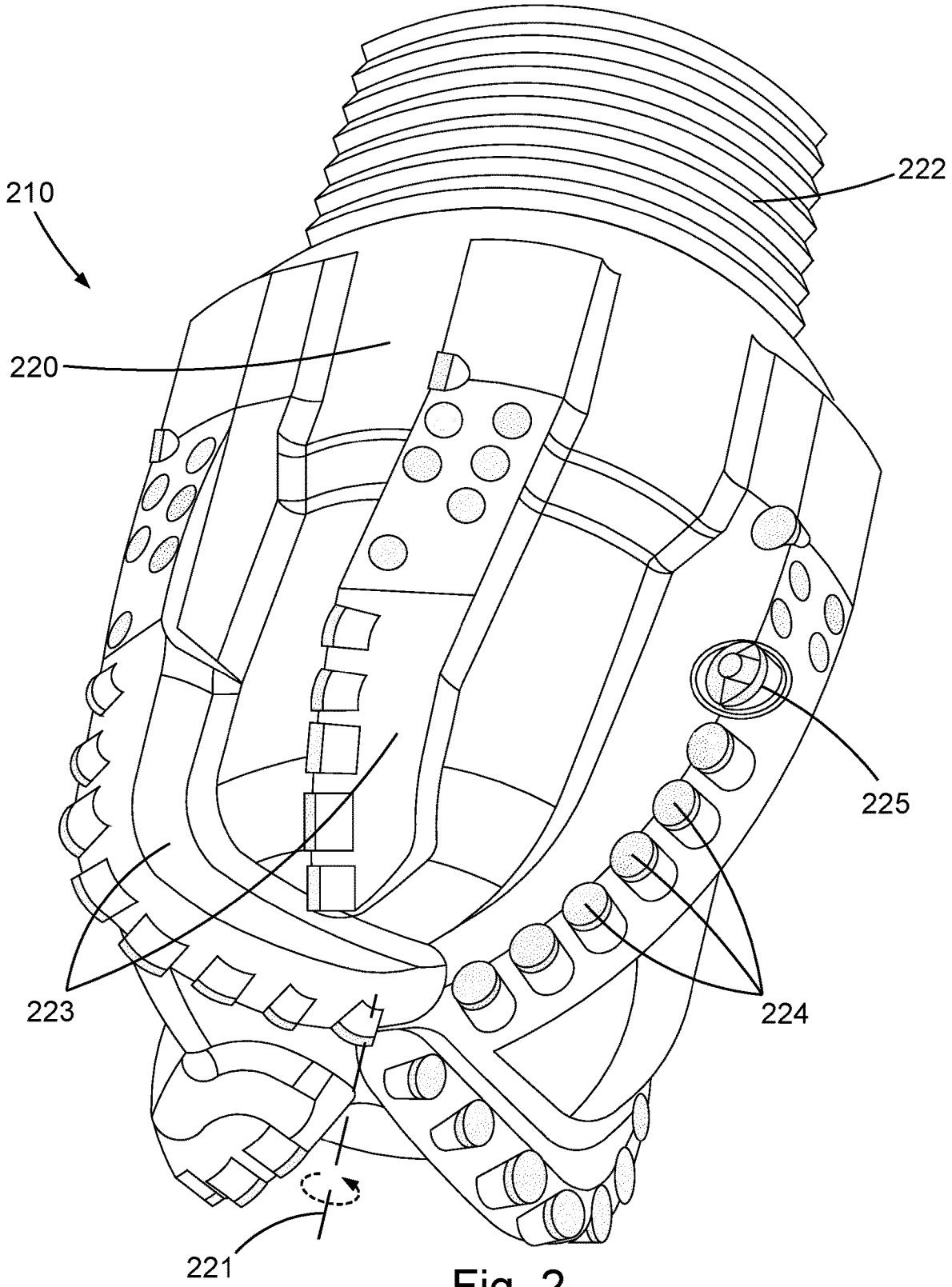
FIG. 2 is a perspective view of an embodiment of a drill bit that may form part of a subterranean drilling operation.

FIG. 2 shows an embodiment of a drill bit 210 of the type that may form part of a subterranean drilling operation as just described. The drill bit 210 may comprise a generally cylindrical body 220 that may be rotated about a central axis 221 thereof. On one end, the body 220 may comprise an attachment mechanism 222, shown here as a series of threads. This attachment mechanism may secure the drill bit 210 to a mating attachment device disposed on a distal end of a drill string (not shown). Opposite from the attachment mechanism 222, the body 220 may comprise a plurality of blades 223 extending both radially and longitudinally therefrom, spaced around the axis 221 of the body 220.

Each of these blades 223 may comprise a leading edge with a plurality of fixed cutting elements 224 protruding therefrom. Each of these fixed cutting elements 224 may comprise a portion of superhard material (i.e. material comprising a Vickers hardness test number exceeding 40 gigapascals) secured to a substrate. The substrate may be formed of a material capable of firm attachment to the body 220. As the drill bit 210 is rotated, the superhard material of each fixed cutting element 224 may engage and degrade tough earthen matter. Each of the fixed cutting elements 224 may be spaced at a constant radius relative to the axis 221 of the body 220 to create an initially cylindrical borehole.

In addition to the fixed cutting elements 224, a rotatable cutting element 225 may also protrude from an exterior of the body 220. This rotatable cutting element 225 may also comprise a portion of superhard material secured to a substrate, similar in some respects to the fixed cutting elements 224. An exposed surface of the rotatable cutting element 225 may comprise a three-dimensional geometry incorporating some of this superhard material. Based on its rotational orientation, this exposed geometry may engage an internal wall of the borehole and remove earthen matter therefrom. Removing this material may change an internal radius of the borehole in some areas. The amount of earthen matter removed may be altered by rotation of the rotatable cutting element 225 relative to the body 220.

Figures 1, 3:
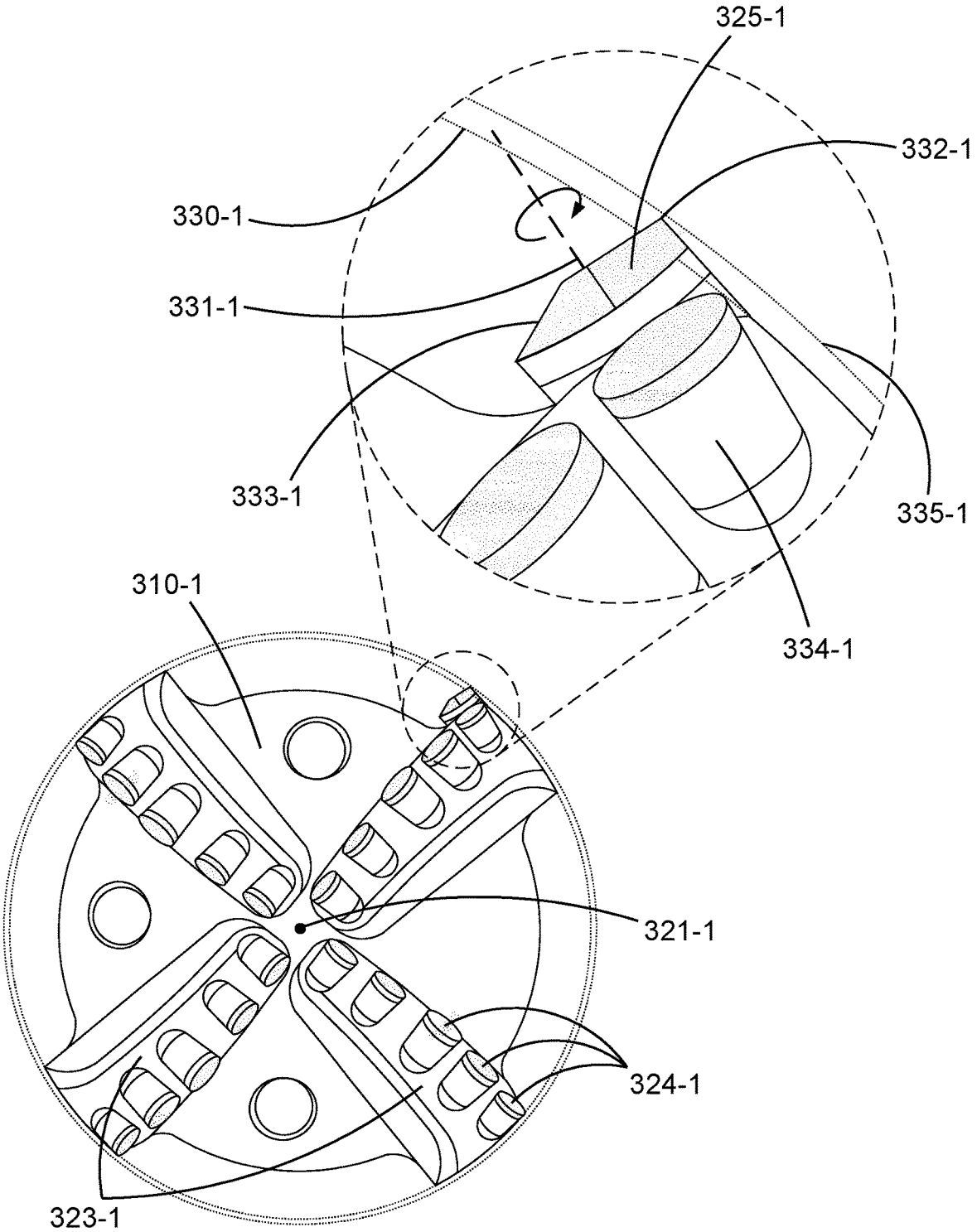
Figures 2, 3:
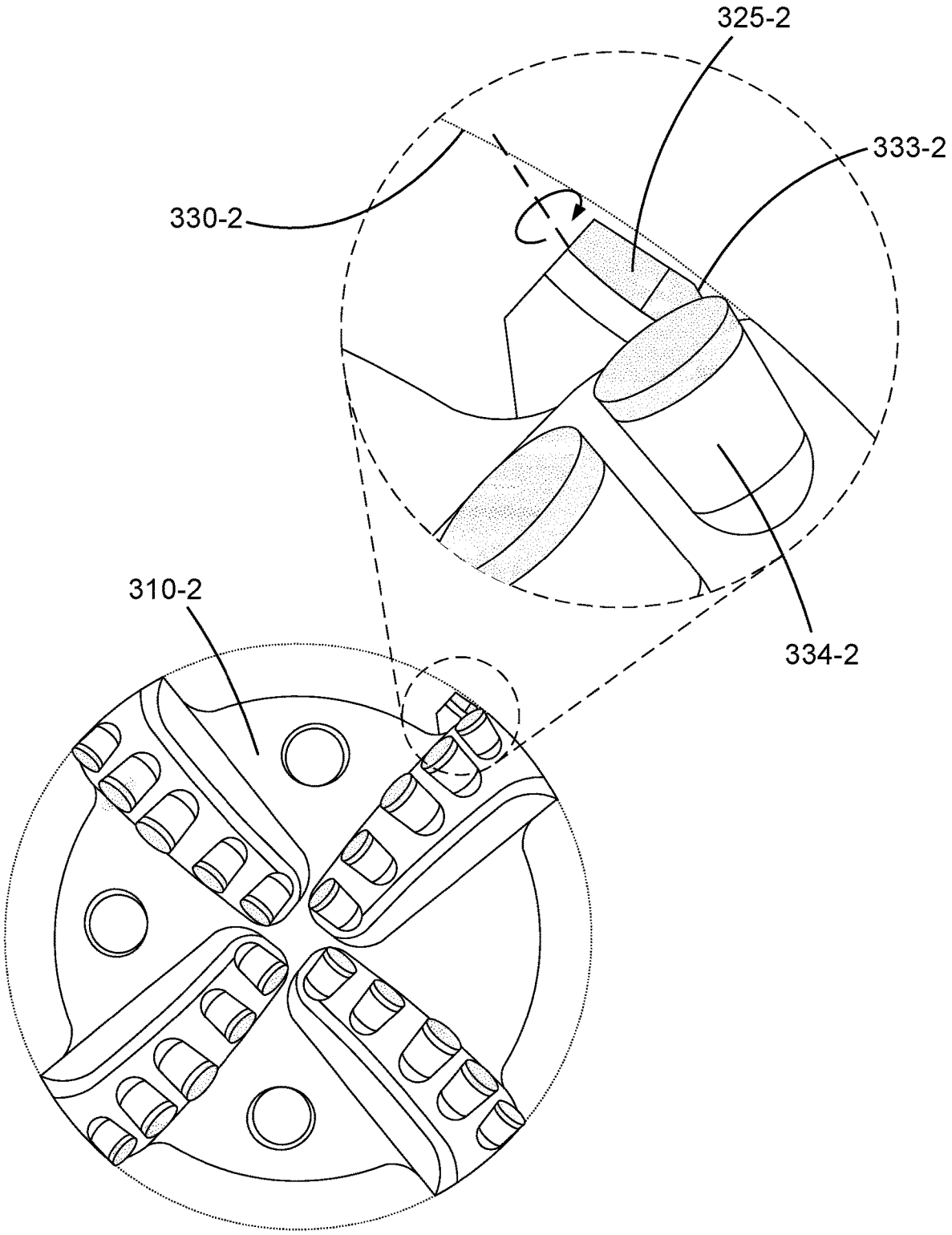

FIG. 3-1 shows an embodiment of a drill bit 310-1 rotatable about an axis 321-1. The drill bit 310-1 comprises a plurality of fixed cutting elements 324-1 exposed on leading edges of a plurality of blades 323-1. At least one of the fixed cutting elements 324-1, positioned farthest from the axis 321-1 of any of the plurality, may form a gauge cutting element 334-1. A distance from the axis 321-1 to this gauge cutting element 334-1 may define an initial radius 330-1 of a borehole as the drill bit 310-1 is rotated.

A rotatable cutting element 325-1 may also protrude from an exterior surface of the drill bit 310-1 in relative proximity to the gauge cutting element 334-1. In contrast to the fixed cutting elements 324-1, this rotatable cutting element 325-1 may be capable of rotation, relative to the drill bit 310-1, about its own axis 331-1. An exposed portion of this rotatable cutting element 325-1 may comprise a three-dimensional geometry comprising an offset distal end 332-1. This exposed geometry may also comprise a slanting surface 333-1 that may stretch from the offset distal end 332-1 toward a proximal base thereof.

The unique aspects of this three-dimensional exposed geometry may allow it to extend radially beyond the initial radius 330-1 in a first rotational orientation as shown. In this first rotational orientation, the slanting surface 333-1 may be positioned in a generally parallel alignment with a leading face of the gauge cutting element 334-1. It is believed that such an alignment may, in some subterranean formations, lead to a smoother extension of the offset distal end 332-1. Also, in this first rotational orientation, the slanting surface 333-1 may be positioned in a generally normal alignment relative to the initial radius 330-1.

When extended in this manner, the offset distal end 332-1 may cut an extended radius 335-1 into the borehole by removing additional earthen matter from an internal wall of the borehole. Removing material from this internal wall may change an internal radius of the borehole, at least in an angular section thereof. This extended radius 335-1 may be restricted to certain angular sections positioned about a circumference of the borehole via deliberate rotational control of the rotatable cutting element 325-1 to create purposefully non-cylindrical cross-sectional shapes.

FIG. 3-2 shows another embodiment of a drill bit 310-2, similar in many regards to that shown in FIG. 3-1. In this embodiment, however, a rotatable cutting element 325-2 protruding from an exterior surface of the drill bit 310-2 may be rotated into a second rotational orientation. In this second rotational orientation, an exposed three-dimensional geometry of the rotatable cutting element 325-2 may remain within an initial radius 330-2 defined by an outermost fixed gauge cutting element 334-2. Specifically, in this second rotational orientation, a slanting surface 333-2 of the exposed geometry may be positioned in a generally tangent alignment relative to the initial radius 330-2 such that it may smoothly avoid an internal wall of a borehole without removing material therefrom.

If extension and retraction of the rotatable cutting element 325-2 is performed in unison with rotation of the drill bit 310-2, such that a given rotational orientation of the drill bit 310-2 correlates with a set rotational orientation of the rotatable cutting element 325-2, then a consistent borehole cross-sectional shape may be created. Various embodiments of such unison rotation may comprise spinning the rotatable cutting element 325-2 in consecutive full turns or oscillating it back and forth. In addition, or alternatively, extension and retraction of the rotatable cutting element 325-2 may be performed at higher frequencies to reduce likelihood of the drill bit 310-2 sticking to the borehole wall.

Figures 1, 4:
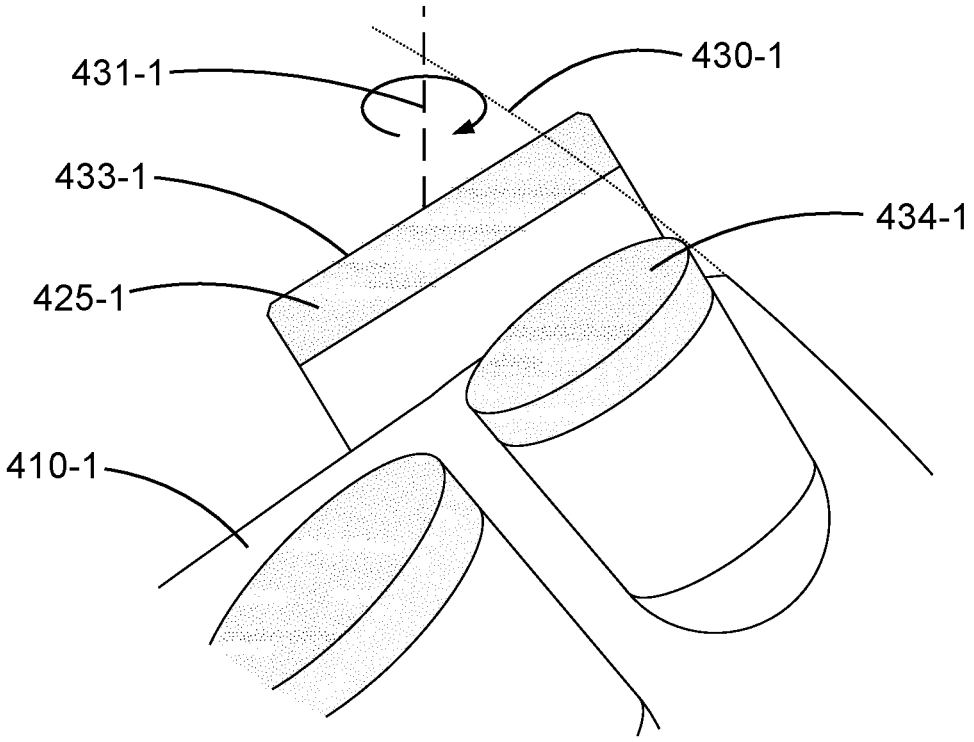
Figures 2, 4:
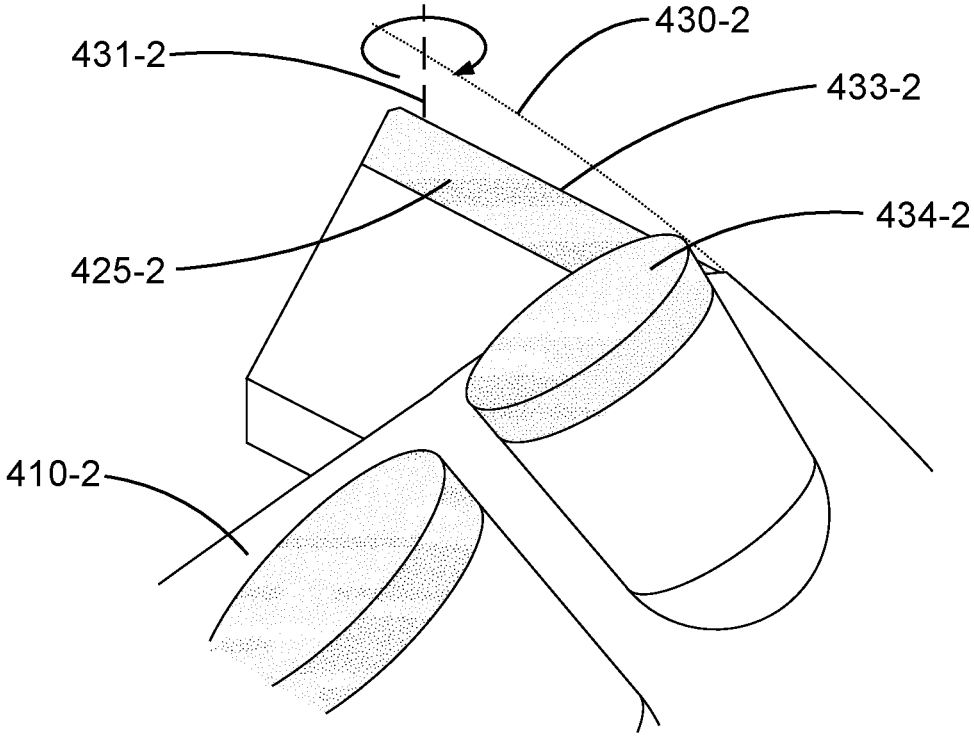

FIGS. 4-1 and 4-2 show embodiments of a rotatable cutting element 425-1, 425-2 protruding from an exterior surface of a drill bit 410-1, 410-2 in relative proximity to a fixed gauge cutting element 434-1, 434-2, also protruding from the exterior surface. In contrast to the gauge cutting element 434-1, 434-2, this rotatable cutting element 425-1, 425-2 may be capable of rotation, relative to the drill bit 410-1, 410-2, about its own axis 431-1, 431-2. An exposed portion of this rotatable cutting element 425-1, 425-2 may comprise a generally flat distal surface 433-1, 433-2.

In a first rotational orientation of the rotatable cutting element 425-1, as shown in FIG. 4-1, the exposed portion may extend radially beyond an initial radius 430-1 defined by a position of the gauge cutting element 434-1. In a second rotational orientation, as shown in FIG. 4-2, the rotatable cutting element 425-2 may be rotated around its axis 431-2 such that the exposed portion may remain within an initial radius 430-2.

Figures 1, 5:
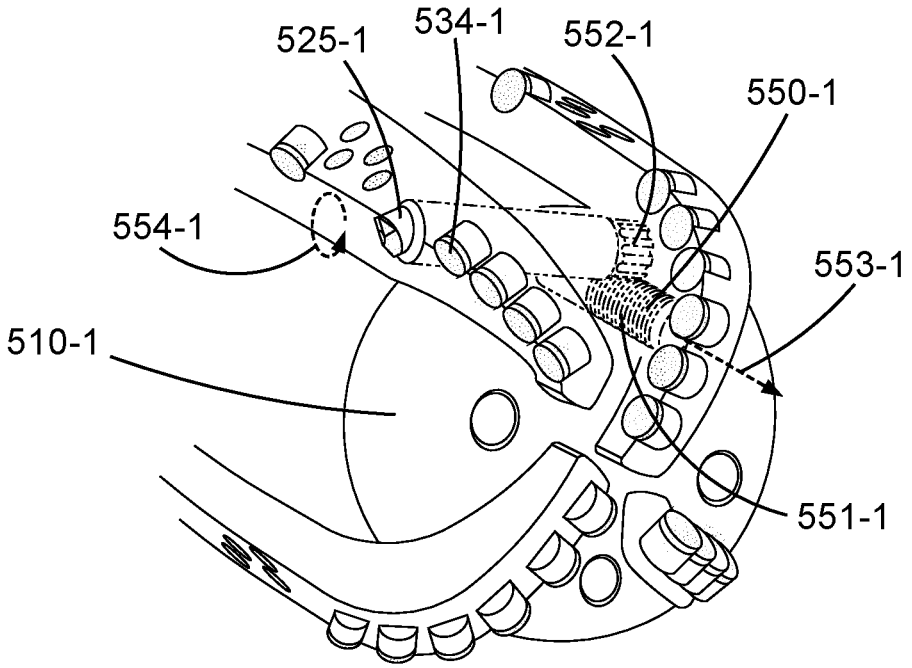
Figures 2, 5:
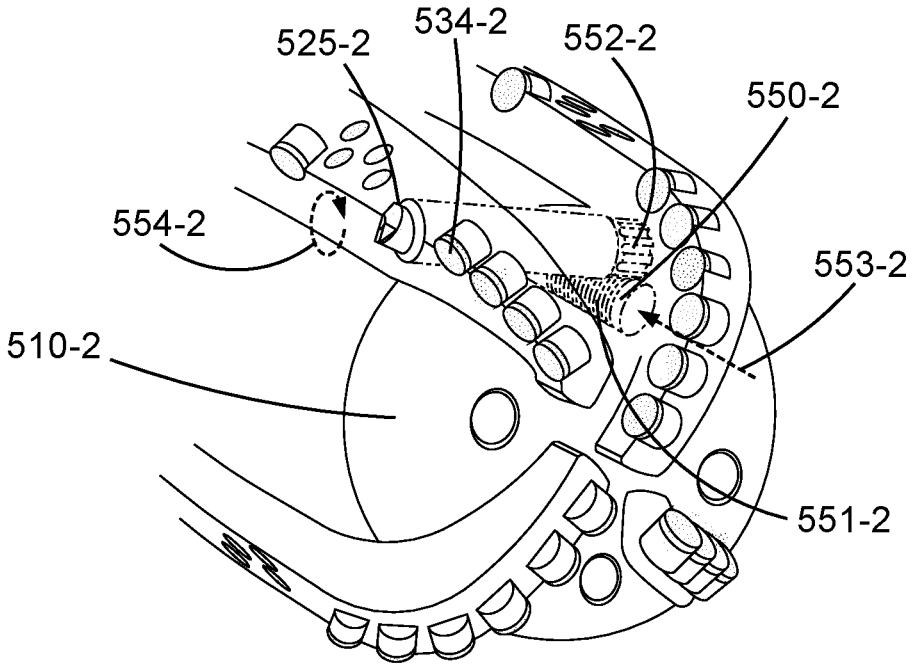

FIGS. 5-1 and 5-2 show embodiments of a drill bit 510-1, 510-2 comprising a rotatable cutting element 525-1, 525-2 protruding from an exterior surface thereof. The rotatable cutting element 525-1, 525-2 may be actively rotated by a torque-generating apparatus 550-1, 550-2. Such a torque-generating apparatus may be powered by any of a variety of known transducers capable of converting electrical, hydraulic or other types of energy into linear or rotary motion; such as a solenoid, piston, turbine or the like. Based on the type of transducer chosen, the torque-generating apparatus may be capable of external control, continuous full rotation, rotational oscillation, holding a set position, etc.

This torque-generating apparatus 550-1, 550-2 may be connected to the rotatable cutting element 525-1, 525-2 via a set of gears. In the embodiment shown, the torque-generating apparatus 550-1, 550-2 comprises an axially-translatable rack gear 551-1, 551-2. Teeth of this rack gear 551-1, 551-2 may mesh with those of a pinion gear 552-1, 552-2 attached to the rotatable cutting element 525-1, 525-2. Thus, as the rack gear 551-1, 551-2 translates, the pinion gear 552-1, 552-2 may rotate the rotatable cutting element 525-1, 525-2. Specifically, as shown in FIG. 5-1, as the torque-generating apparatus 550-1 translates 553-1 the rack gear 551-1 outward along its axis, the pinion gear 552-1 rotates 554-1 the rotatable cutting element 525-1 into an extended position, radially past a fixed gauge cutting element 534-1. As shown in FIG. 5-2, as the torque-generating apparatus 550-2 translates 553-2 the rack gear 551-2 inward, the pinion gear 552-2 rotates 554-2 the rotatable cutting element 525-2 into a retracted position, radially within a fixed gauge cutting element 534-2. Such an arrangement could be reversed in alternate embodiments.

Figures 1, 6:
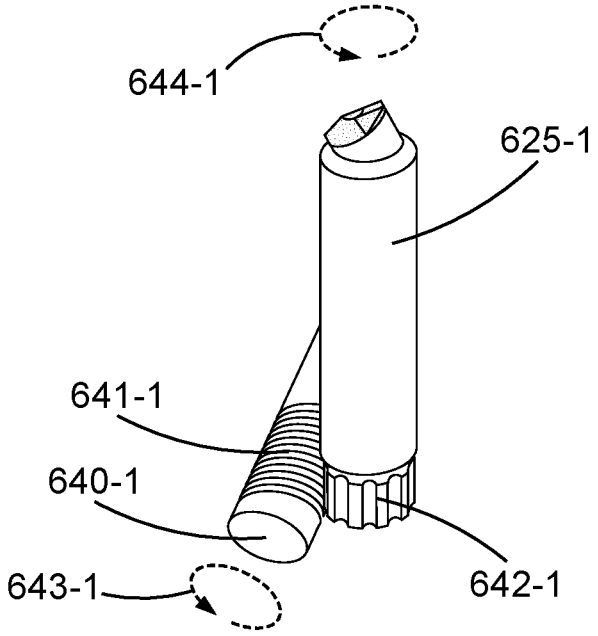
Figures 2, 6:
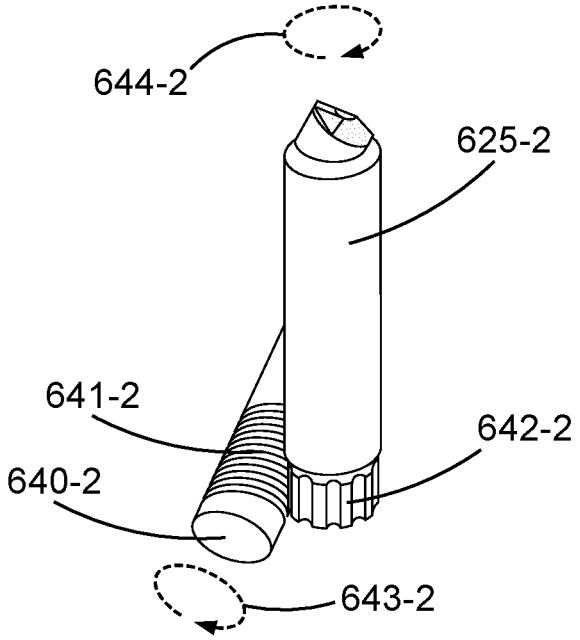

FIGS. 6-1 and 6-2 show embodiments of a rotatable cutting element 625-1, 625-2 that may be rotated by a torque-generating apparatus 640-1, 640-2. In these embodiments, the torque-generating apparatus 640-1, 640-2 is connected to the rotatable cutting element 625-1, 625-2 via a worm-wheel gear configuration. In particular, the torque-generating apparatus 640-1, 640-2 may comprises a rotatable worm gear 641-1, 641-2. Teeth of this worm gear 641-1, 641-2 may mesh with those of a worm wheel gear 642-1, 642-2 attached to the rotatable cutting element 625-1, 625-2. Thus, as the worm gear 641-1, 641-2 rotates, the worm wheel gear 642-1, 642-2 may also rotate the rotatable cutting element 625-1, 625-2. Specifically, as shown in FIG. 6-1, as the torque-generating apparatus 640-1 rotates 643-1 the worm gear 641-1 in a first direction, the worm wheel gear 642-1 rotates 644-1 the rotatable cutting element 625-1 into an extended position. As shown in FIG. 6-2, as the torque-generating apparatus 640-2 rotates 643-2 the worm gear 641-2 in a second direction, the worm wheel gear 642-2 rotates 644-2 the rotatable cutting element 625-2 into a retracted position. Such an arrangement could be reversed in alternate embodiments.

Figures 1, 7:
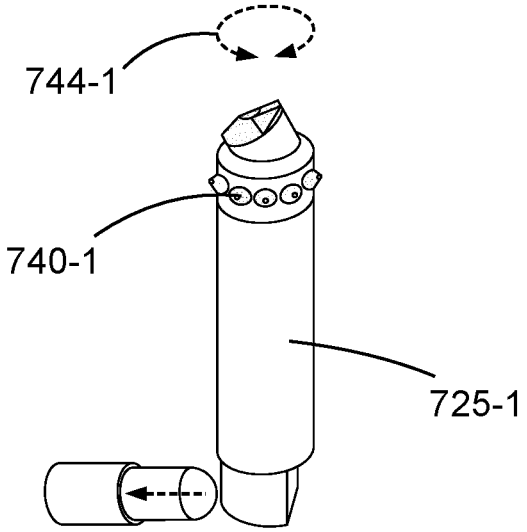
Figures 2, 7:
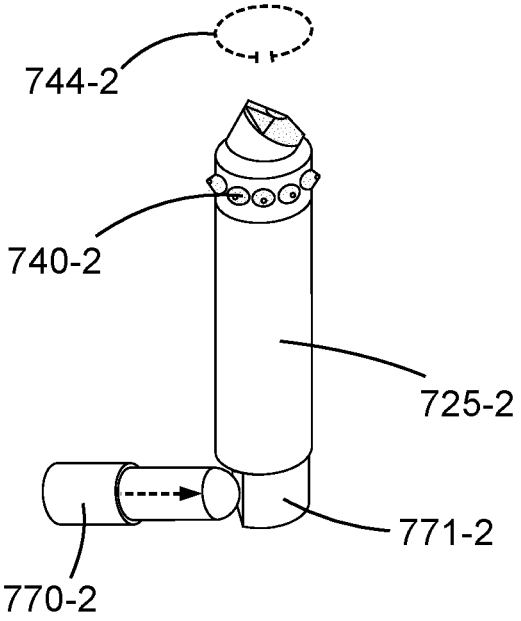

FIGS. 7-1 and 7-2 show embodiments of a rotatable cutting element 725-1, 725-2 that may be rotated by a torque-generating apparatus 740-1, 740-2. In these embodiments, the torque-generating apparatus 740-1, 740-2 wraps around a circumference of the rotatable cutting element 725-1, 725-2 and comprises a geometry capable of protruding from a drill bit and engaging with an external formation through which the drill bit may be advancing. While thus engaged, rotation of the drill bit or its advancement through a formation may cause this torque-generating apparatus 740-1, 740-2 to rotate the rotatable cutting element 725-1, 725-1.

The rotatable cutting element 725-1, shown in FIG. 7-1, may be freely rotatable 744-1 about an axis thereof. In FIG. 7-2, however, a braking apparatus 770-2 may engage a cam 771-2 portion of the rotatable cutting element 725-2. While engaged, this braking apparatus 770-2 may rotationally secure the rotatable cutting element 725-1 and restrain 744-2 it from free rotation.

Figure 8:
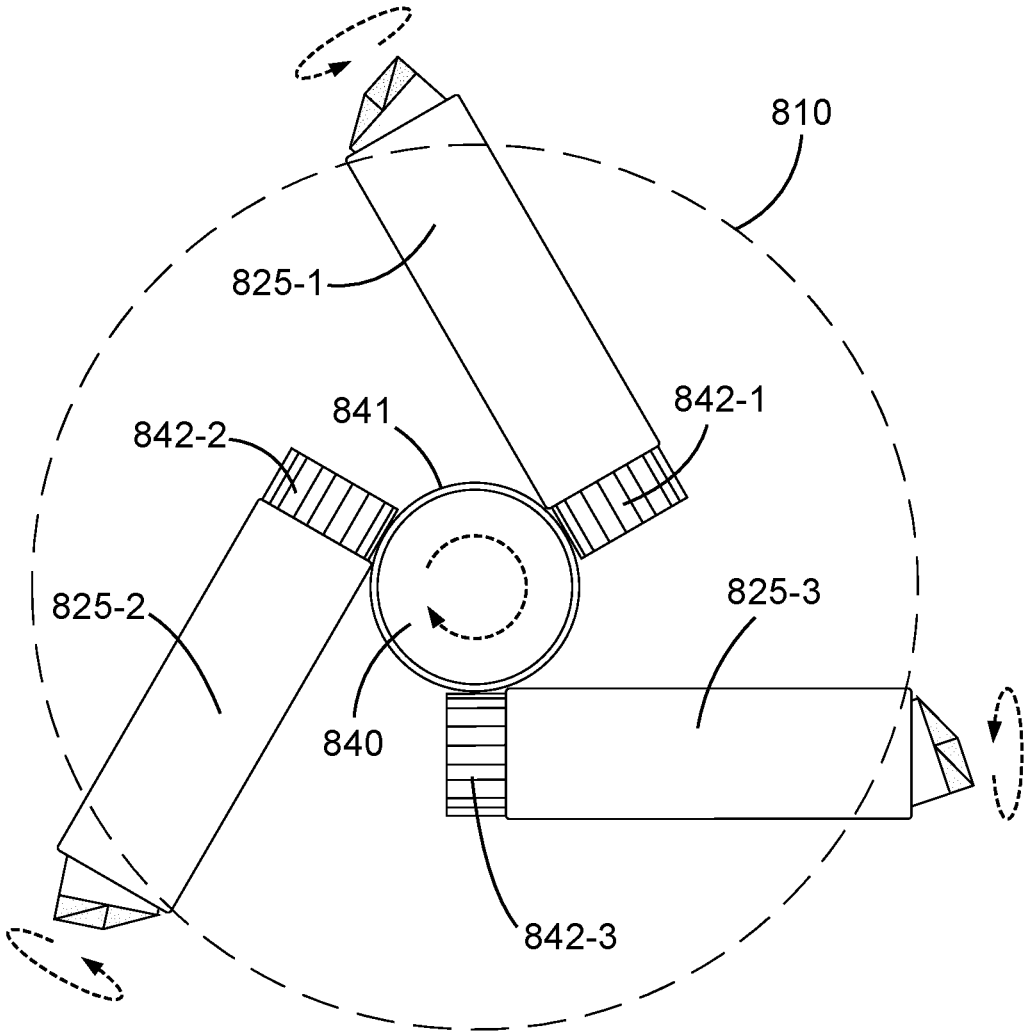
FIG. 8 is an orthogonal view of an embodiment of multiple rotatable cutting elements all rotatable by means of a single torque-generating apparatus.

FIG. 8 shows an embodiment of multiple rotatable cutting elements 825-1, 825-2 and 825-3 that all may be rotated by a single torque-generating apparatus 840. Similar in some respects to the torque-generating apparatus shown in FIGS. 5-1 and 5-2, this torque generating apparatus 840 may comprise a worm gear 841 with teeth wrapping therearound. In this embodiment however, each of the multiple rotatable cutting elements 825-1, 825-2 and 825-3 may comprise a unique worm wheel gear 842-1, 842-2 and 842-3, respectively, connected thereto. Teeth of each of these worm wheel gears 842-1, 842-2 and 842-3 may mesh with those of the worm gear 841 such that as the torque-generating apparatus 840 rotates the worm gear 841 each of the rotatable cutting elements 825-1, 825-2 and 825-3 may rotate simultaneously. As can be seen, each of these rotatable cutting elements 825-1, 825-2 and 825-3 may extend away from the torque-generating apparatus 840, and protrude from an exterior of a drill bit 810, in different radially-angular directions without interfering with one another. While a worm-wheel gear system is shown, alternate embodiments may comprise other arrangements comprising multiple rotatable cutting elements connected to a single torque-generating apparatus.

Whereas this discussion has referred to the drawings attached hereto, it should be understood that other and further modifications apart from those shown or suggested herein, may be made within the scope and spirit of the present disclosure.

The invention claimed is:

1. A downhole drilling assembly, comprising:

a body rotatable about an axis thereof;

a fixed cutting element protruding from an exterior of the body at a constant radius from the axis; and a rotatable cutting element comprising a superhard material secured to a substrate, the rotatable cutting element also protruding from the exterior of the body along an element axis and is configured to rotate about the element axis, wherein the element axis extends through the substrate and the superhard material of the rotatable cutting element; wherein in a first rotational orientation about the element axis, the rotatable cutting element extends radially beyond the constant radius; and in a second rotational orientation about the element axis, the rotatable cutting element remains radially within the constant radius.

2. The downhole drilling assembly of claim 1, wherein the rotatable cutting element comprises a generally flat distal surface.

3. The downhole drilling assembly of claim 1, wherein the rotatable cutting element comprises an offset distal end and a slanting surface from the offset distal end toward a proximal base thereof.

4. The downhole drilling assembly of claim 1, wherein in the first rotational orientation a flat or slanting surface of the rotatable cutting element is generally normal to the constant radius.

5. The downhole drilling assembly of claim 1, wherein in the first rotational orientation a flat or slanting surface of the rotatable cutting element is generally parallel with a face of the fixed cutting element.

6. The downhole drilling assembly of claim 1, wherein in the second rotational orientation a flat or slanting surface of the rotatable cutting element is generally tangent to the constant radius.

7. The downhole drilling assembly of claim 1, further comprising a torque-generating apparatus capable of rotating the rotatable cutting element.

8. The downhole drilling assembly of claim 7, wherein the torque-generating apparatus contacts an external formation.

9. The downhole drilling assembly of claim 7, wherein the torque-generating apparatus is connected to the rotatable cutting element via gears.

10. The downhole drilling assembly of claim 9, wherein the torque-generating apparatus comprises a rotatable worm gear mating with a worm wheel of the rotatable cutting element.

11. The downhole drilling assembly of claim 9, wherein the torque-generating apparatus comprises a translatable rack gear mating with a pinion of the rotatable cutting element.

12. The downhole drilling assembly of claim 7, further comprising an additional rotatable cutting element capable of rotation by the torque-generating apparatus.

13. The downhole drilling assembly of claim 12, wherein the additional rotatable cutting element protrudes from the exterior of the body at a radially-angular offset from the rotatable cutting element.

14. The downhole drilling assembly of claim 1, further comprising a braking apparatus capable of limiting rotation of the rotatable cutting element.

15. The downhole drilling assembly of claim 14, wherein the rotatable cutting element is freely rotatable when not limited by the braking apparatus.

16. The downhole drilling assembly of claim 14, wherein the rotatable cutting element comprises a cam that catches on the braking apparatus until released.

17. A method for downhole drilling, comprising:

rotating a body about an axis thereof;

forming a borehole with a fixed cutting element protruding from an exterior of the body at a constant radius from the axis;

removing material from an interior of the borehole with a rotatable cutting element also protruding from the exterior of the body along an element axis, wherein the rotatable cutting element comprises a superhard material secured to a substrate, the element axis extends through the substrate and the superhard material of the rotatable cutting element, and the rotatable cutting element is configured to rotate about the element axis; and altering an amount of material removed by rotating the rotatable cutting element about the element axis such that it extends radially beyond the constant radius in a first rotational orientation and remains radially within the constant radius in a second rotational orientation.

18. The method for downhole drilling of claim 17, wherein rotating the rotatable cutting element is performed in unison with rotating the body such that a given rotational orientation of the body will correlate with a set rotational orientation of the rotatable cutting element.

19. The method for downhole drilling of claim 17, wherein rotating the rotatable cutting element comprises oscillating back and forth.

20. The method for downhole drilling of claim 17, wherein removing material from the interior of the borehole comprises changing an internal radius of the borehole in an angular section.

* * * * *